US011939732B2

(12) United States Patent
Chatten et al.

(10) Patent No.: US 11,939,732 B2
(45) Date of Patent: Mar. 26, 2024

(54) DEVICE FOR WARNING OR BARRIER GATE

(71) Applicant: Fencing Supply Group Acquisition, LLC, Dunwoody, GA (US)

(72) Inventors: Andrew F. Chatten, Elburn, IL (US); Ted J. Fiock, Elburn, IL (US)

(73) Assignee: FENCING SUPPLY GROUP ACQUISITION, LLC, Dunwoody, GA (US)

( * ) Notice: Subject to any disclaimer, the term of this patent is extended or adjusted under 35 U.S.C. 154(b) by 1131 days.

(21) Appl. No.: 16/658,680

(22) Filed: Oct. 21, 2019

(65) Prior Publication Data

US 2020/0123723 A1 Apr. 23, 2020

Related U.S. Application Data

(60) Provisional application No. 62/748,497, filed on Oct. 21, 2018.

(51) Int. Cl.
*E01F 13/06* (2006.01)
*E01F 9/00* (2016.01)

(52) U.S. Cl.
CPC ..... *E01F 13/06* (2013.01); *E01F 9/00* (2013.01)

(58) Field of Classification Search
CPC ..... E01F 9/00; E01F 13/06
See application file for complete search history.

(56) References Cited

U.S. PATENT DOCUMENTS

| | | | | |
|---|---|---|---|---|
| 4,219,969 | A * | 9/1980 | Reinitz | E01F 13/06 49/141 |
| 4,318,079 | A * | 3/1982 | Dickinson | E01F 13/06 340/928 |
| 5,884,432 | A * | 3/1999 | DeLillo | E01F 13/06 49/49 |
| 8,181,392 | B1 * | 5/2012 | Farber | E01F 13/06 49/234 |
| 9,487,224 | B1 * | 11/2016 | Pless | E05F 15/643 |
| 2002/0134020 | A1 * | 9/2002 | Luetzow | E01F 13/06 49/9 |
| 2002/0152683 | A1 * | 10/2002 | Burnette | E01F 13/06 49/49 |
| 2009/0244889 | A1 * | 10/2009 | Rihl | E01F 13/06 362/152 |
| 2011/0113690 | A1 * | 5/2011 | Luetzow | E01F 13/06 49/506 |
| 2012/0011774 | A1 * | 1/2012 | Arnaud | E01F 13/06 49/49 |

(Continued)

*Primary Examiner* — Abigail A Risic
(74) *Attorney, Agent, or Firm* — McDermott Will & Emery LLP

(57) ABSTRACT

A device for a warning or barrier gate and methods that use the device can include a first arm section that includes a tenon and an arrangement of apertures through the tenon, and a second arm section that includes a mortise and an arrangement of apertures through the mortise. The apertures can align, and fasten together, to form at least part of an arm assembly for the warning or barrier gate. Manufacture of the device can occur in the field during installation of the warning or barrier gate. The device can be reciprocated 180 degrees from a closed position perpendicular to a roadway to an open position that rests parallel to the roadway.

16 Claims, 17 Drawing Sheets

(56) References Cited

U.S. PATENT DOCUMENTS

| | | | | |
|---|---|---|---|---|
| 2012/0210646 | A1* | 8/2012 | Shaw | B61L 29/16<br>16/337 |
| 2017/0313333 | A1* | 11/2017 | Brandt | E01F 13/08 |
| 2018/0363259 | A1* | 12/2018 | Bullock | E01F 15/088 |

* cited by examiner

100 / 200

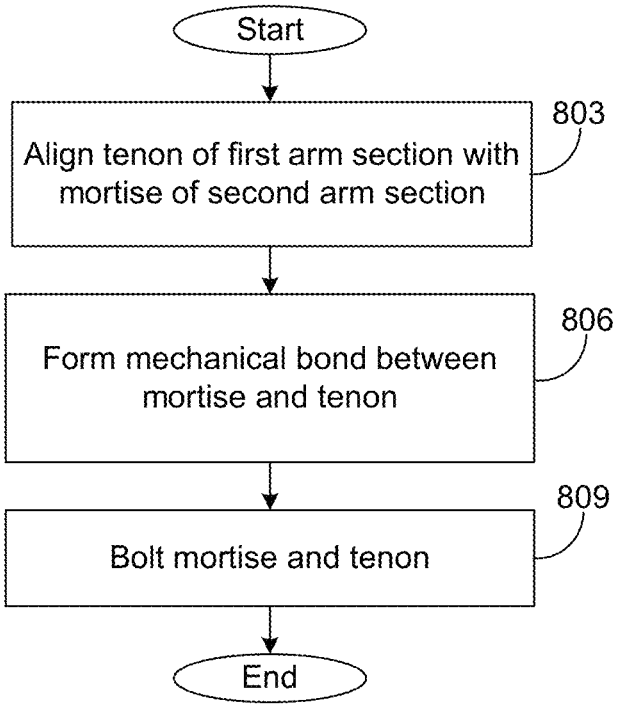
FIG. 17
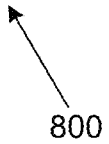

DEVICE FOR WARNING OR BARRIER GATE

CROSS-REFERENCE TO RELATED APPLICATIONS

This application claims the benefit of and priority to U.S. Provisional Patent Application No. 62/748,497 entitled "DEVICE FOR WARNING OR BARRIER GATE" filed on Oct. 21, 2018, which is expressly incorporated by reference as if fully set forth herein in its entirety.

BACKGROUND

Warning and barrier gates can be used for traffic control on movable bridges, high occupancy vehicle (HOV) lanes, reversible lanes, and similar applications. Some warning gates operate to pivot in a vertical plane via a mechanical 4-bar linkage. Conventional warning and barrier gates require welding to manufacture an arm mounting assembly, which can be problematic and require significant effort, time, and expense.

SUMMARY

Various embodiments of a device and methods for an arm assembly for a warning or barrier gate are described. In one embodiment, an arm assembly for a warning or barrier gate includes a first arm section with first terminal ends, where one of the first terminal ends includes a tenon with a first end. The first arm section also has an arrangement of apertures through the first end and the tenon. The first arm section can include a side arm with at least one terminal end configured to be connected to a flange of a lift shaft.

The arm assembly also includes a second arm section with second terminal ends, where one of the second terminal ends includes a mortise with a second end. The second arm section has an arrangement of apertures through the second end and the mortise. The arrangement of apertures through the first end and the tenon, and the arrangement of apertures through the second end and the mortise are located on the first arm section and the second arm section, respectively, such that the arrangement of apertures through the first end and the tenon aligns with the arrangement of apertures through the second end and the mortise when a first element is aligned with a second element. The mortis can include a groove and the tenon can include a mating protrusion, wherein the first element is substantially U-shaped and the second element is a mirror image of the first element.

The second arm section can include a tube arm with a portion curved at about a 45 degree angle, and at least one terminal end configured to be connected to a crossmember. The crossmember can include a tenon and an arrangement of apertures through the tenon. The arm assembly can further include an operator system that is configured to be mounted at about a 45 degree angle relative to at least one of: a roadway, a side of a structure, a breakaway arm, or an orientation of an operator system of a 90 degree arm.

In another embodiment, a method of manufacturing an arm assembly for a warning or barrier gate can include aligning a first arm section and a second arm section, where the first arm section terminates in a tenon, and the second arm section terminates in a mortise, and the mortise is proximate to and aligns with the tenon when the first arm section is aligned with the second arm section. The method can include forming a mechanical bond between the mortise and the tenon. The method can also include bolting the mortise and the tenon to form at least part of the arm assembly, and bolting the at least part of the arm assembly to a flange of a lift shaft. In some aspects, the method can include bolting a second arm assembly to another flange of the lift shaft to form a parallel arm assembly. In some other aspects, the second arm section can include a tube arm, where a portion of the tube arm is curved at about a 45 degree angle.

In another embodiment, a method of reciprocating a warning or barrier gate between an open position and a closed position can include activating a motor to cause rotation of a lift shaft. The method can also include moving at least part of an arm assembly greater than 90 degrees along the lift shaft by the rotation of the lift shaft. Moving the at least part of the arm assembly greater than 90 degrees can include moving the at least part of the arm assembly about 180 degrees along the lift shaft.

The direction of the movement of the arm assembly can be made according to a direction of the rotation of the lift shaft. The movement of the at least part of the arm assembly can be effective to move at least one arm assembly and generate a torque that is effective to pivot the warning or barrier gate between an open and a closed position, or about a rotational center of the lift shaft. The open position can be substantially parallel to a structure. The closed position can be substantially perpendicular to a structure.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

In addition, all optional and preferred features and modifications of the described embodiments are usable in all aspects of the entire disclosure taught herein. Furthermore, the individual features of the dependent claims, as well as all optional and preferred features and modifications of the described embodiments are combinable and interchangeable with one another.

BRIEF DESCRIPTION OF THE DRAWINGS

The components in the drawings are not necessarily to scale, emphasis instead being placed upon clearly illustrating the principles of the present disclosure. Moreover, in the drawings, like reference numerals designate corresponding parts throughout the several views.

FIG. 17 is a flowchart illustrating an example method for manufacturing a device for a warning or barrier gate, in accordance with various embodiments of the present disclosure.

DETAILED DESCRIPTION

Figure 1:
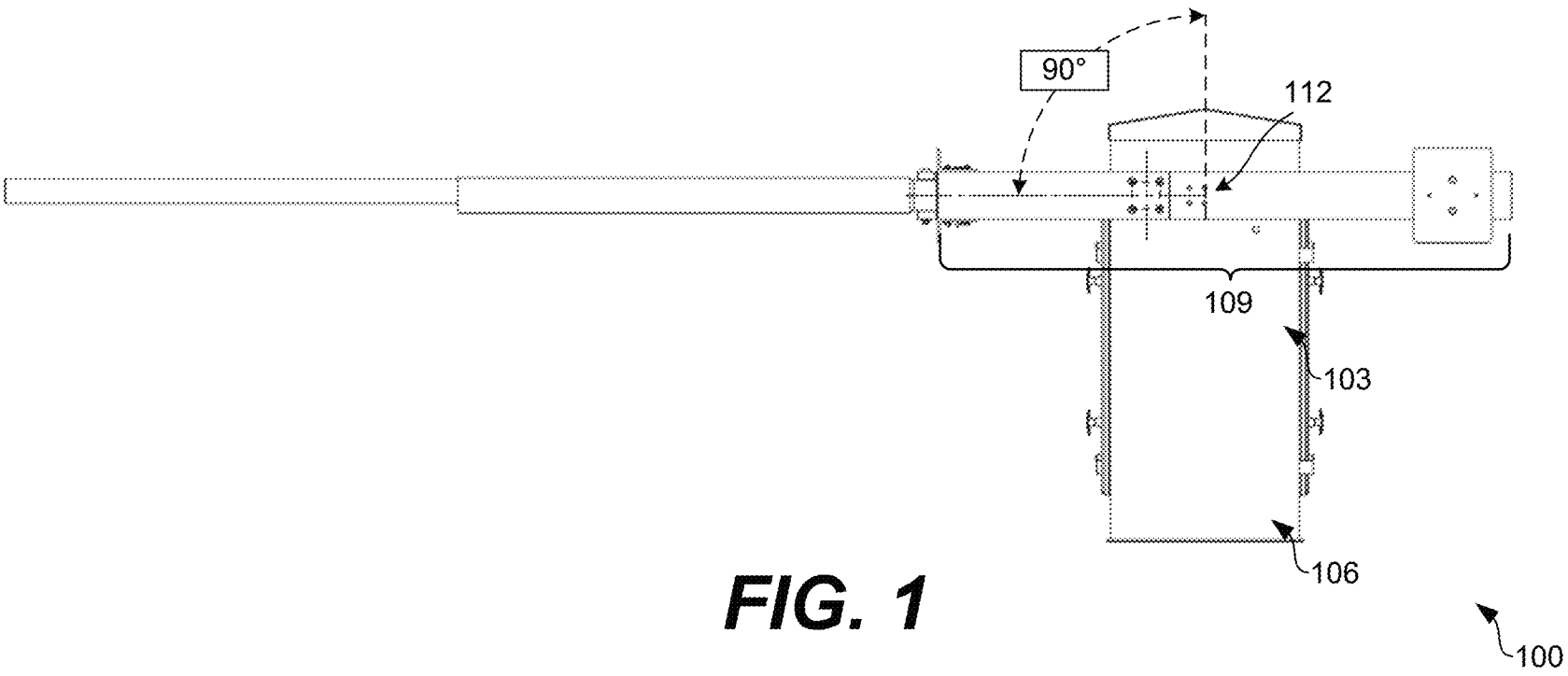
FIG. 1 illustrates a side elevation view of a device for a warning or a barrier gate, in accordance with various embodiments of the present disclosure.

A warning or barrier gate can be used for traffic control on movable bridges, high occupancy vehicle (HOV) lanes, reversible lanes, and similar applications. Conventional warning and barrier gates can require welding on an arm mounting assembly of the gate, which is not ideal.

The present application relates to an arm assembly that can be removably fastened together to reduce (or eliminate) welding to manufacture, assemble, attach, or affix an arm assembly to a warning or barrier gate. In contrast to conventional arm assemblies, the present disclosure can provide arms with channels (and other components) having apertures (such as bolt apertures) that allow the arms to be attached using removable fasteners such as bolts, screws, studs, setscrews, or other fasteners that can fasten without welding. The arm assembly be used with an operator system and a warning or barrier gate that pivots 90 degrees in a vertical plane, referred to herein as a 90 degree gate.

The present disclosure also relates to a 180 degree gate and operator. The gate arm and 180 degree operator system are designed to rotate the gate arm so that in an open position or "road open" condition the gate arm is positioned to rest parallel to the roadway. This configuration provides for reduced degradation of mechanical components compared to conventional arm assemblies. When combined with a yoke, docking, or saddle system for securing the arm, the need to remove the arm during adverse weather such as a hurricane or a tropical storm can be reduced. Providing an ability to store the arm parallel to the roadway can also reduce many safety hazards, and create a more aesthetically pleasing warning gate or barrier gate installation. The gate arm and 180 degree operator system can also reciprocate one or more arm assemblies between the open position and a closed position (e.g., perpendicular to a roadway).

The disclosed arm mounting assemblies include components having curved channels, structural shapes, and/or tubes. The assemblies can include tube arms with angular bends that can bolt together with side arms.

The present disclosure describes an arm assembly, or other device for a warning or barrier gate, that can bolt together for use as an arm of a barrier or warning gate. The arm assembly can include mortise and tenon joints to assist with joining the arm mounting assemblies and to create steel tenon bolted joinery. Components of the operator arm assembly can also be cold roll formed.

No welding is required to assemble the device for the warning gate or the barrier gate. The warning gate and the barrier gate described herein are useful to reduce manufacturing and other costs associated with using a gate on movable bridges, high occupancy vehicle (HOV) lanes, reversible lanes, pedestrian walkways and bike paths, or other applications. Compared to conventional barrier and warning gates, the present design is thus able to reduce (or eliminate) welding to assemble the gates.

The arm assembly of the present disclosure is designed to meet or exceed standards of the Manual on Uniform Traffic Control Devices (MUTCD) and the American Association of Highway Transportation Officials (AASHTO) for gates on movable bridges, reversible lanes of traffic, pedestrian walkways and bike paths or commercial applications. Regarding operation, the arm assembly can be operated as a 90 degree (vertical) warning or barrier arm and pivot in the vertical plane via a mechanical linkage. In other embodiments, the arm assembly can be operated as a 180 degree warning or barrier arm to rotate so that in the "road open" condition the gate arm is positioned to rest parallel to the roadway. The arm assembly can also vary to allow the gate arm to be positioned to rest in other positions, as can be appreciated.

A disclosed operator system can include a drive that includes a motor, gearbox, and brake package for reciprocating a warning or barrier gate between an open position and a closed position. The disclosed operator system can be scaled up (or scaled down) depending on the application. Material sizes may vary based upon the size (length) and type of gate (warning or barrier). The gearbox can be a hollow shaft gearbox such that the gearbox shaft directly drives the gate arm mounting structure. In one embodiment, an operator system can utilize a heavy-duty industrial dual stage gear reducer and integrated motor drive gearbox. The gearbox can be a one-piece construction which couples into a framework of the operator system. In some examples, a drive shaft (e.g., 2⅜" diameter) is attached through the gearbox to provide adequate torque (e.g., 16,000 in-lbs) to raise and lower the warning gate arm assembly. Each end of the drive shaft extends through the side of a housing with a mounting hub to attach to the arm assembly. A rotary cam switch box can be mounted below the arm drive shaft and chain driven with a chain from the main drive gearbox.

In some other embodiments, an encoder or other electronic device is provided to set and resolve the angle of the cam limit. For example, embodiments can provide a programmable logic controller (PLC) unit. The PLC unit can be external to the drive system, or can be combined with the hollow shaft gear system such that the gear system includes the encoder. Compared to conventional warning gates, this approach can eliminate the cam box, mounting structure, chain and sprocket drives of a warning gate that does not use the encoder system. The disclosed approach can also reduce maintenance associated with the cam box, switches, and other associated components.

This disclosure provides a housing that can include a steel frame for housing various electrical and mechanical components of the disclosed devices. For example, the steel frame may comprise a welded heavy-duty tubular steel frame of 1½" square-tubing of ¼" wall thickness. In some examples, the frame can be welded to a 2½"×3½"×¼ angle iron base to provide a robust structure for mounting of the operator system to its foundation providing for fastener (e.g., anchor bolt) locations. The frame of the housing can be stainless steel or post fabrication hot dipped galvanized.

In some examples, a drive system can include a dual stage gearbox motor unit. The drive system is a self-contained drive system which easily fastens into the main framework of a frame of the operator system. The drive unit features a 1010:1 drive ratio between the motor and output shaft. The output of the gearbox can be a hollow shaft style to accommodate a drive shaft such as a 2.375" diameter drive shaft. The output speed of the unit can be sufficient to fully raise or fully lower the warning gate at speeds that can be controlled and adjusted through the motor's Variable Frequency Drive system (VFD). The VFD enables a sinusoidal action when in operation. The gearbox can be filled with synthetic oil for operational temperature ranges from about minus forty degrees Celsius (−40° C.) to about forty degrees Celsius (+40° C.). According to various embodiments the drive housing includes special surface protection paint for outdoor application.

The use of the VFD drive to control the motor gearbox provides a practically unlimited combination of acceleration/deceleration options. The operator system can alter the frequency of the motor drive to speed up or slow down the total cycle time without any mechanical alterations to the drive system. The device uses a multistage gearbox, so the gear ratios involved allow drive of motors that are at least half of the normal size used in conventional warning gates. The disclosed device, operator system, and multistage gearbox save energy, lower costs with smaller motor starters, and provide more cabinet space within the housing of the device.

According to various embodiments, the drive motor can be about ½ horsepower, 460 Volt, 3 phase, 60 Hz, or other (as needed based upon gate size and application) inverter drive rated for VFD interface. The outside of motor housing includes special corrosion protection with an IP66 rating for outside application. The motor/drive system includes a special internal braking system as described below.

The drive motor can include an electronic braking system with about 44 in-lbs. of braking torque to the output shaft of the operator motor. A special hand brake release is included for manual operation of the drive system providing 44,400 of brake torque.

The output of the fan shaft on the motor can have a socket connection to provide for a manual operation. A hand brake release can be used to disengage the system brake and a battery powered drill unit with drive socket can be used to drive the motor/gearbox system manually.

Any of the devices described herein can include eight (8) cam switches mounted in a National Electrical Manufacturers Association (NEMA) one (1) or four (4) rated enclosure. The enclosure is capable of housing up to fourteen (14) limit cams.

According to various embodiments a drive system can provide the following features: gear ratio 101:1, number of primary/secondary stages 2/3, output Speed 1.7 RPM, motor HP ½ HP, motor voltage 460 VAC, frequency 60 HZ, brake voltage 120 V, overhung load capacity 6,740 lbs, output torque 16,000 lb-in, torque capacity 26,550 lb-in, nameplate service factor 1.65, insulation class F, brake IP66 rating with 44 lb-in torque, corrosion protection rating IP66, dimensions 55.5" (140.97 cm) High 33" (83.82 cm) wide and 18" (45.72 cm) deep (or to other specifications), mounting base dimensions 39" (99.06 cm) wide and 24.5" (62.23 cm) deep (or to other specifications).

The disclosed devices can also include various wiring and switches. A manual disconnect switch can be included to protect servicing personnel. Safety switches can be installed on any of the access doors to disable operation of the warning gate while being maintained our serviced. Safety switches can include an override function for the use during installation and testing if specified. Control components and terminal blocks can be installed inside a NEMA 1 or 4 electrical enclosure inside the housing. Control wiring can be clearly labeled and referenced on a wiring diagram included with the unit. The device can include wiring of a #14 American wire gauge (AWG) stranded variety. Warning lights, such as per MUTCD/AASHTO regulations/specifications, can be installed along the upper side of the warning arm assembly, wired, and controlled by a controller. Options can include a gong, lift points, harness tie offs, stainless steel cover skins, and hot dipped galvanized cover skins and frame.

Turning to the drawings, FIG. 1 illustrates a side elevation view of a device 100 for a warning or a barrier gate. Briefly described, the device 100 includes a housing 103 with a mount 106 for attaching the device 100 to a structure, such as a bridge or water-based crossing, or a structure near a land-based crossing. The arm assembly 109 provides apertures 112 for fastening the arm assembly 109 to a shaft or other mechanism of an operator system (not depicted) that can pivot the arm assembly 109.

Regarding operation, the device 100 is depicted in FIG. 1 in a closed position or a "road closed" condition such that a tip of the device 100 is perpendicular to (e.g., blocking) a direction of travel. Drive of the drive shaft of the operator system can cause the arm assembly 109 to pivot to a "road open" position. For example, the arm assembly 109 can pivot about 90 degrees in a vertical plane.

The arm assembly 109 can include one or more arm sections that are configured to be aligned and form a mechanical bond. The arm assembly 109 includes a first arm section that terminates in a tenon or other mating protrusion, and a second arm section that terminates in a mortise or other groove. In FIG. 1, the mortise and the tenon have been removeably fastened (e.g., bolted) to form at least part of the arm assembly 109.

Figure 2:
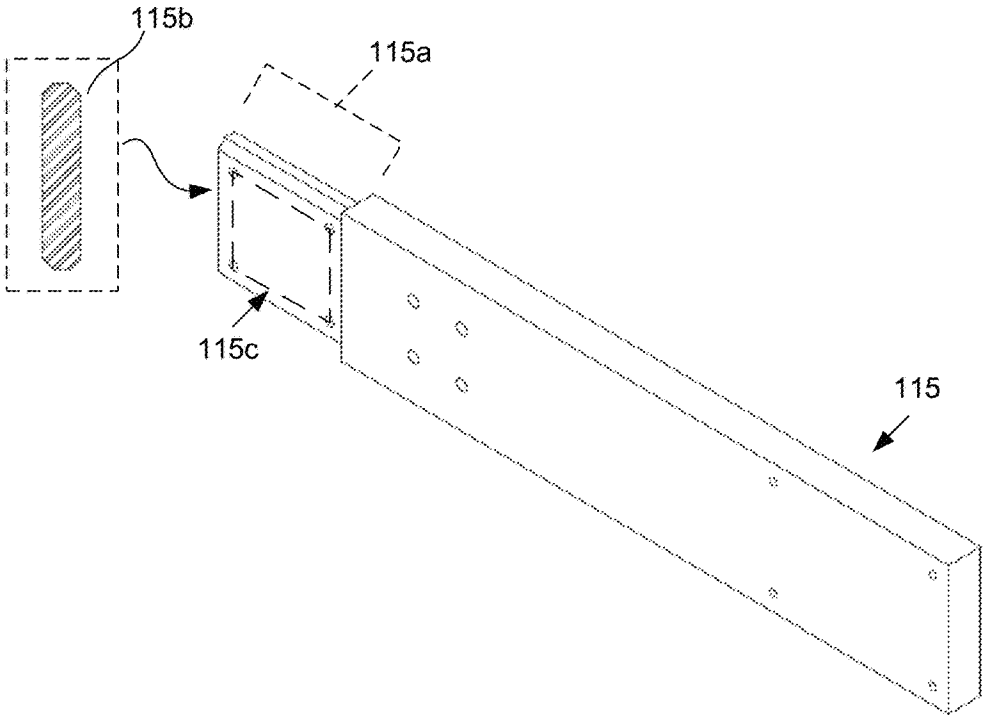
FIG. 2 illustrates an example of arm section of a device for a warning or barrier gate, in accordance with various embodiments of the present disclosure.

Moving on to FIG. 2, shown is an example of an arm section 115 of a device 100 for a warning or barrier gate. The arm section 115 includes a tenon 115*a* having an end 115*b*. There is an arrangement of apertures 115*c* through the end 115*b* of the tenon 115*a*. The end 115*b* shows that the tenon 115*a* can include an element that is substantially U- or V-shaped, inverted U- or V-shaped, or another shape that provides a mating protrusion. In this way, a mechanical bond can be formed between the tenon 115*a* and a mortise or groove associated with a second arm section, as will be described with reference to FIG. 3. The arrangement of apertures 115*c* are located on the arm section 115 such that the arrangement of apertures 115*c* through the end 115*b* of the tenon 115*a* aligns with an arrangement of apertures located on the second arm section.

Figure 3:
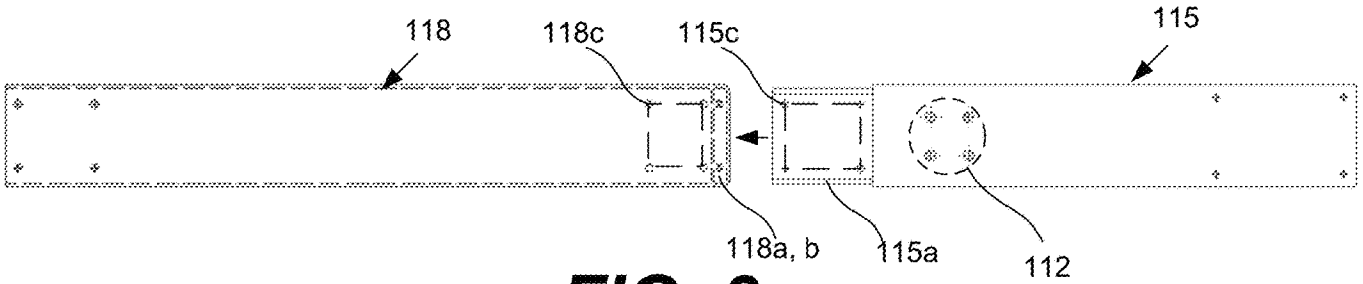
FIG. 3 illustrates an example of forming a mechanical bond between a mortise and a tenon of a device for a warning or barrier gate, in accordance with various embodiments of the present disclosure.

In FIG. 3, the first arm section 115 having the tenon 115*a* is shown with a second arm section 118 having a mortise 118*a* with an end 118*b*. The second arm section 118 can also be described as a tube arm. There is an arrangement of apertures 118*c* through the end 118*b* of the mortise 118*a*. The mortise 118*a* can include a groove or other shape that is the mirror image of the mating protrusion of the tenon 115*a*, such as substantially U- or V-shaped, and inverted U- or V-shaped.

A mechanical bond can be formed between the tenon 115*a* and the mortise 118*a* for example following aligning the first arm section 115 and the second arm section 118. As indicated by the arrow in FIG. 3, the arrangement of apertures 118*c* through the end 118*b* of the mortise 118*a*, and the arrangement of apertures 115*c* through the end 115*b* of the tenon 115*a* align for example when the mating protrusion of the tenon 115*a* is aligned with the groove of the mortise 118*a*.

The mortise 118*a* and the tenon 115*a* can be coupled together to form at least part of the arm assembly 109 (FIG. 1). In some examples, the first arm section 115, or another element of the arm assembly 109, provides apertures 112 (FIG. 1) for fastening the arm assembly 109 (FIG. 1) to a shaft or other mechanism of an operator system (not depicted) that can pivot the arm assembly 109.

Figure 4:
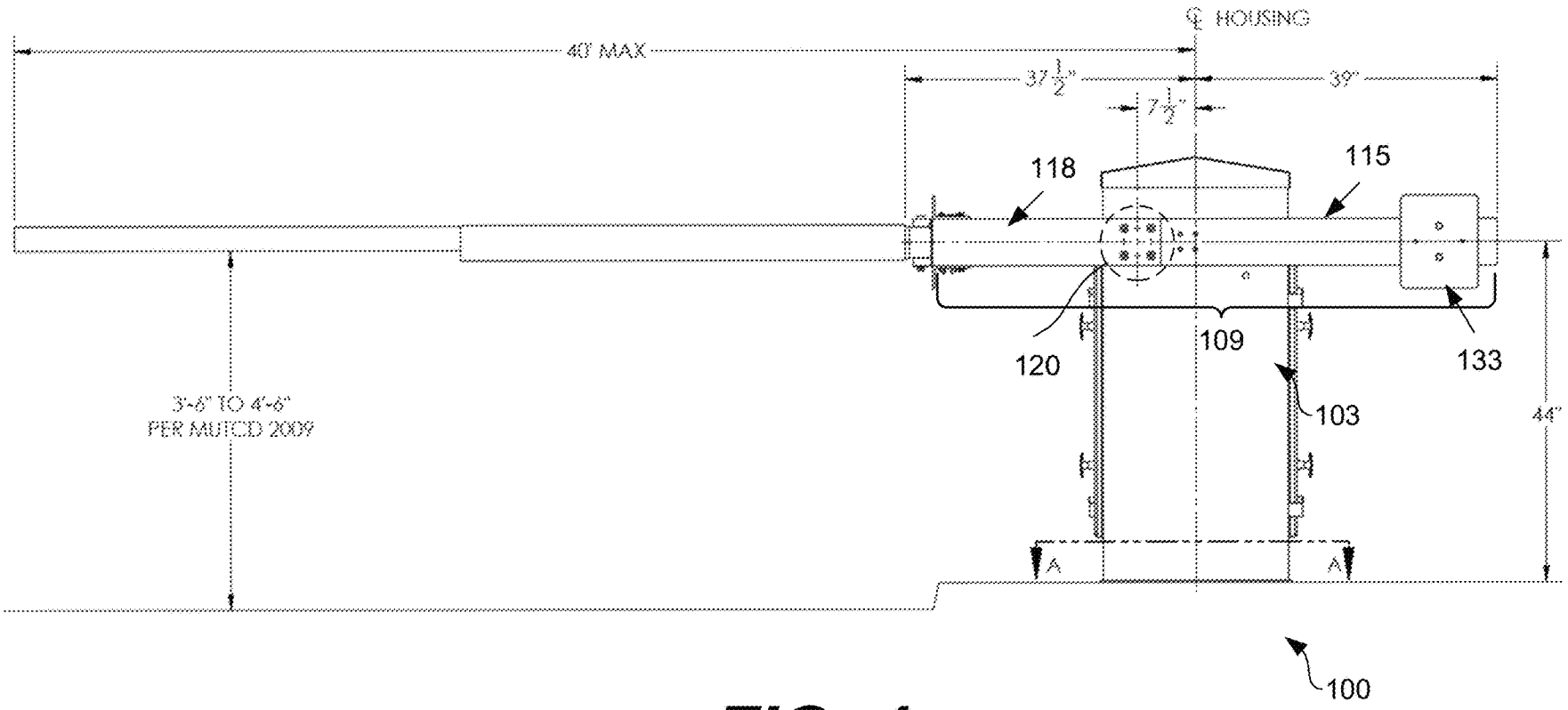
FIG. 4 illustrates another side elevation view of the device of FIG. 1, in accordance with various embodiments of the present disclosure.

Referring now to FIG. 4, shown is a side elevation view of a device 100 for a warning or a barrier gate. The circle 120 indicate the locations where apertures 118*c* of the mortise 118*a* (FIG. 3) and the apertures 115*c* of the tenon 115*a* (FIG. 3) have been coupled together to form at least part of the arm assembly 109. Regarding dimensions, a combined length of the first arm section 115 and the second arm section 118 can be greater than about 74 inches. The combined length can also be less than about seventy-six and one half (76½) inches. As depicted in FIG. 4, a length of the second arm section 118 can be less than about thirty-seven and one half (37½) inches and a length of the first arm section 115 can be less than about forty-six and one half (46½) inches. FIG. 4 depicts that a combined length from near a point on the pivot mount and anti-kickback mechanism 124 (FIG. 5) to an end of the first arm section 115 can be about seventy-six and one half (76½) inches.

The arm assembly 109 can be affixed between about 1-10 inches from a center line of the housing 103. FIG. 4 shows that a distance from a center line of the location (bolted 120) where the first arm section 115 and the second arm section 118 are fastened together to the center line of the housing 103 can be about seven and one-half (7½) inches.

The device 100 can also include one or more counterweights 133 attached to the arm assembly 109. The arm assembly 109 can include counterweights 133 such as steel plates, blocks, or other weights fastened to the first arm section 115. The counterweights 133 can be provided with a powder coated finish or hot dip galvanized finish. The counterweight 133 can be attached to the first arm section 115 to balance the arm assembly 109. Counterweights can be sectional and permit at least about 10% adjustment.

Figure 5:
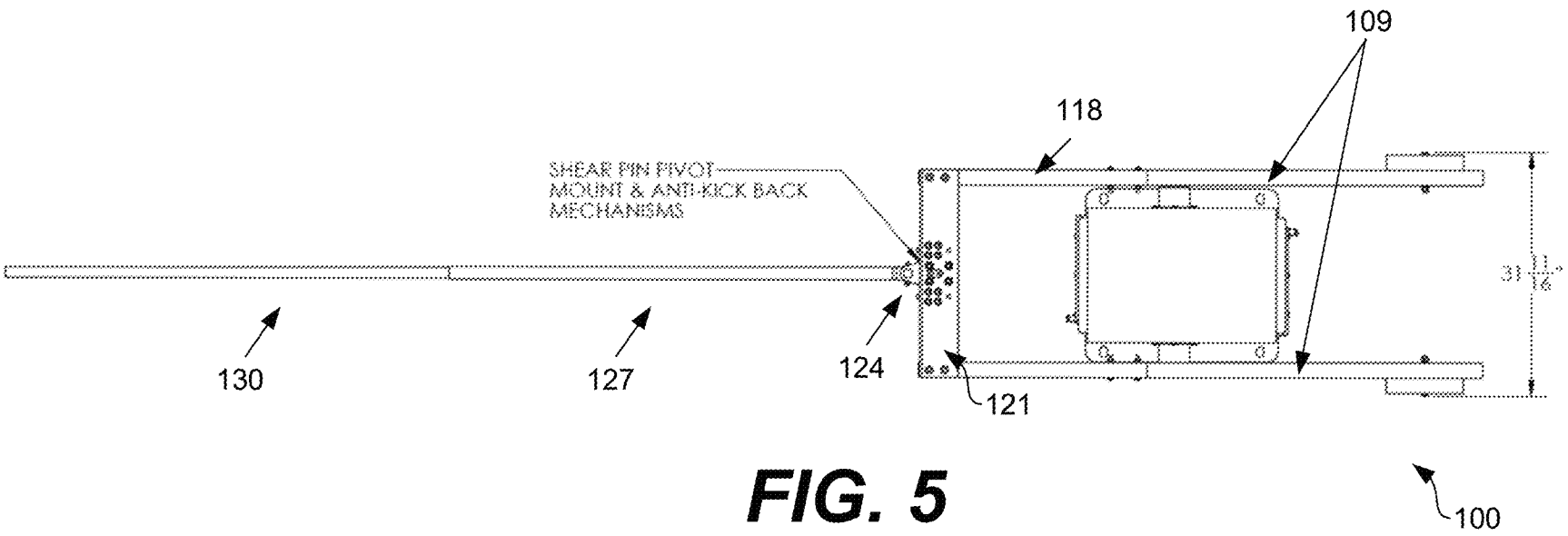
FIG. 5 illustrates a top view of the device of FIG. 1, in accordance with various embodiments of the present disclosure.

Referring now to FIG. 5, shown is a top view of a device 100 for a warning or a barrier gate. The example device 100 depicted includes an arm assembly 109 that includes two parallel arm channels. The device 100 can include a crossmember 121 that is substantially perpendicular to the arm assembly 109. The crossmember 121 can be steel (or other material) that is of size and strength to support a breakaway arm, or other component, as further discussed below.

The first arm section 115 or the second arm section 118 can be of aluminum construction using rectangular tubing telescoping type sections, carbon steel channels, hot dip galvanized, painted aluminum, or any other configuration that can be rigidly affixed to the ends of the main arm shaft.

The crossmember 121 can include a tenon and an arrangement of apertures through the tenon. The tenons of the crossmember 121 can include u-shaped ends or other mating protrusions that allow the crossmember 121 to be affixed or fastened to a portion of a top and a bottom of the second arm section 118 or two parallel arm channels, such as the arm assemblies 109. For example, one of the terminal ends of the second arm section 118 can include a mortise that is the mirror of the tenon of the crossmember 121.

The device 100 can also include a breakaway arm that is affixed to the crossmember 121 by a pivot mount and anti-kickback mechanism 124 to minimize damage in a collision. The breakaway arm can include a base section 127 of tubing and a tip section 130. FIG. 5 depicts that a distance between a respective outer edge of a counterweight 133 attached to each of the arm assemblies 109 can be about thirty-one and eleven sixteenths (31 11/16) inches. In some other embodiments, the base section 127 and/or the tip section 130 can be 2" (51 mm) diameter AISI 4150 with a minimum tensile strength of 140,000 psi. The tip section 130 can be of fiberglass construction. Optional attachments such as stainless steel truss cables, eyebolts, and associated hardware can also be used to support the arm between the arm assembly and a drive frame. Surfaces of the tip section 130 and the base section 127 can be covered with alternating red and white high intensity reflective stripes.

Figure 6:
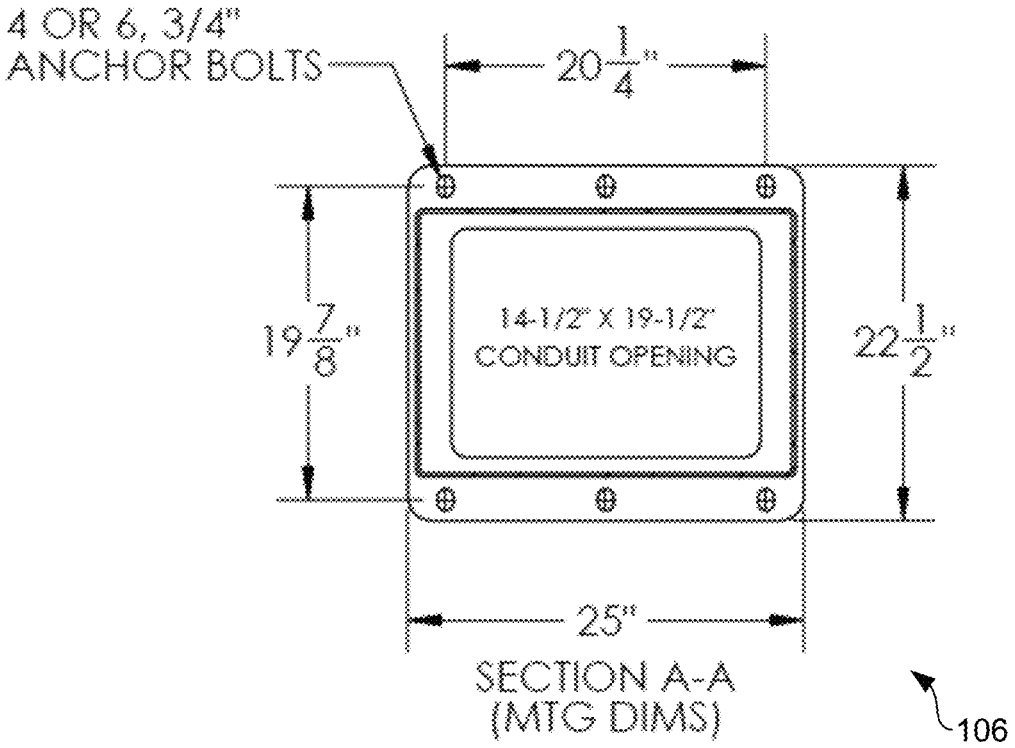
FIG. 6 illustrates a bottom view of a mount of the device of FIG. 1, in accordance with various embodiments of the present disclosure.

Moving on to FIG. 6, shown is a bottom view of a mount 106 of a device 100 for a warning or a barrier gate. The mount 106 allows the device 100 to be mounted to a foundation or a structure using four (4) or six (6) fasteners, e.g., ¾" (20 mm) diameter bolts. The example shown in FIG. 5 depicts the mount 106 of the housing 103 provides four (4) holes on a twenty and one quarter (20¼) inch by nineteen and seven eighths (19⅞) inch pattern that can each accept a ¾" diameter fastener such as an anchor bolt. Two additional holes can be provided between the two holes on the twenty and one quarter (20¼) inch side.

Figure 7:
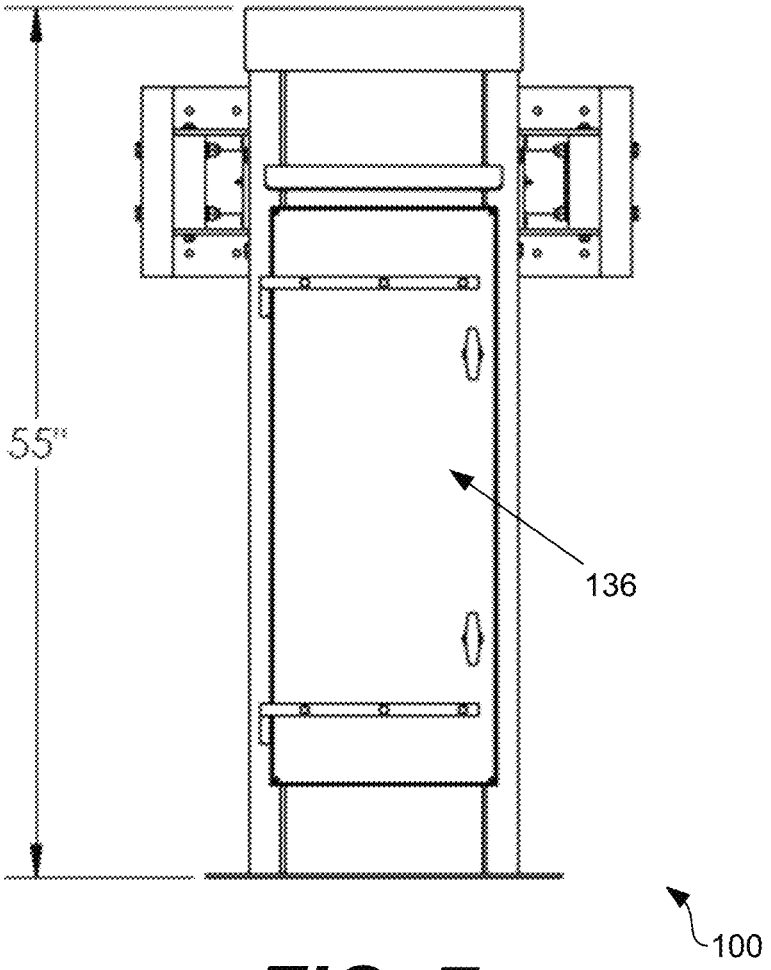
FIG. 7 illustrates a rear elevation view of the device of FIG. 1, in accordance with various embodiments of the present disclosure.

Turning to FIG. 7, shown is a rear elevation view of a device 100 for a warning or a barrier gate. FIG. 7 depicts a cover 136 attached to the housing 103 to provide a weatherproof seal. The cover 136 can be on lift-off hinges and secured, such as by using one or more tamper-resistant security machine screws with stainless steel split lock washers. The cover 136 can allow access to an operator enclosure of the housing 103 (FIG. 1) for internal electrical panel, controls, and the manual override system, and provide for weather resistance, security, and maintenance accessibility for authorized personnel. The cover 136 can also include a locking mechanism.

Figure 8:
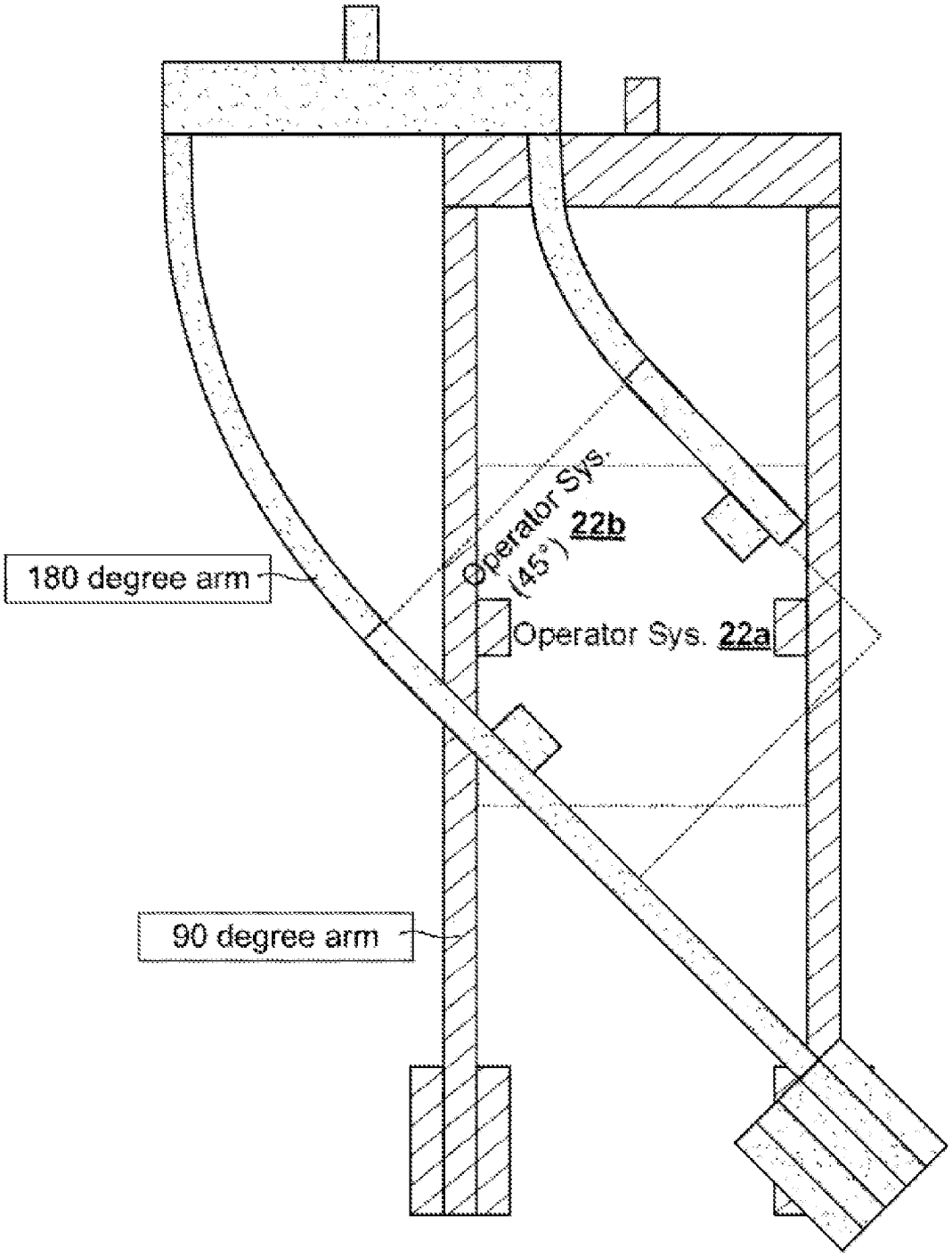
FIG. 8 illustrates an example of a layout of a 90 degree arm and a layout of a 180 degree arm of a device for a warning or barrier gate, in accordance with various embodiments of the present disclosure.

Referring to FIG. 8, shown is an example of a layout of a 90 degree arm of a device 100 for a warning or barrier gate and a layout of a 180 degree arm of a device 200 for a warning or barrier gate. While the description of FIGS. 1-7 has been mainly in terms of a 90 degree warning gate or barrier gate, the disclosed design is equally applicable to a 180 degree warning or barrier gate. Regarding the functionality of the 180 degree gate and operator system, the 180 degree operator system is designed to rotate the arm assembly so that in the "road open" condition the arm assembly is positioned to rest parallel to the roadway. This configuration provides for reduced degradation of the mechanical components as the gate arm is exposed to lesser wind loads. When combined with a yoke, docking, or saddle system for securing the arm, the need to remove the arm during adverse weather such as a hurricane or a tropical storm can be reduced. Providing an ability to store the arm parallel to the roadway can also reduce many safety hazards, and create a more aesthetically pleasing warning gate or barrier gate installation.

The drawing of FIG. 8 depicts an operation of a 90 degree arm assembly and operator system 22*a* in a diagonal shading. The drawing also depicts an operation of a 180 degree arm assembly and operator system 22*b* in a dotted shading. The arm assemblies are shown with counterweights installed. The 180 degree arm assembly and operator system 22*b* as depicted includes a bolt together design and two curved arms. An arm mounting of the 180 degree arm assembly and operator system 22*b* can be about five (5) inches closer to the roadway as compared to a centerline of the 90 degree design. Further, an arm mounting location of the 180 degree design can be nineteen (19) to twenty (20) inches as compared to a centerline of the 90 degree design. The device 100 or the device 200 can also include various washers, nuts, bolts, screws, bushings, and other fasteners 1*a* as can be appreciated.

The layout of the 180 degree arm of a device 200 for a warning or barrier gate shown in the dotted shading depicts that the operator system 22*b* can be mounted or oriented at about a 45 degree angle relative to the roadway, a side of the structure, a breakaway arm, or an orientation of an operator system of the 90 degree arm. In some aspects of the 180 degree arm assembly, the operator system 22*b* can activate a motor to cause rotation of a lift shaft, and move at least a part of the 180 degree arm assembly greater than 90 degrees along the lift shaft. In some examples, the operator system 22*b* will drive the motor for a defined period of time that is greater than a period of time required to drive a 90 degree arm from an open position to a closed position (or reciprocate the 90 degree arm between the open position and the closed position).

Figure 9:
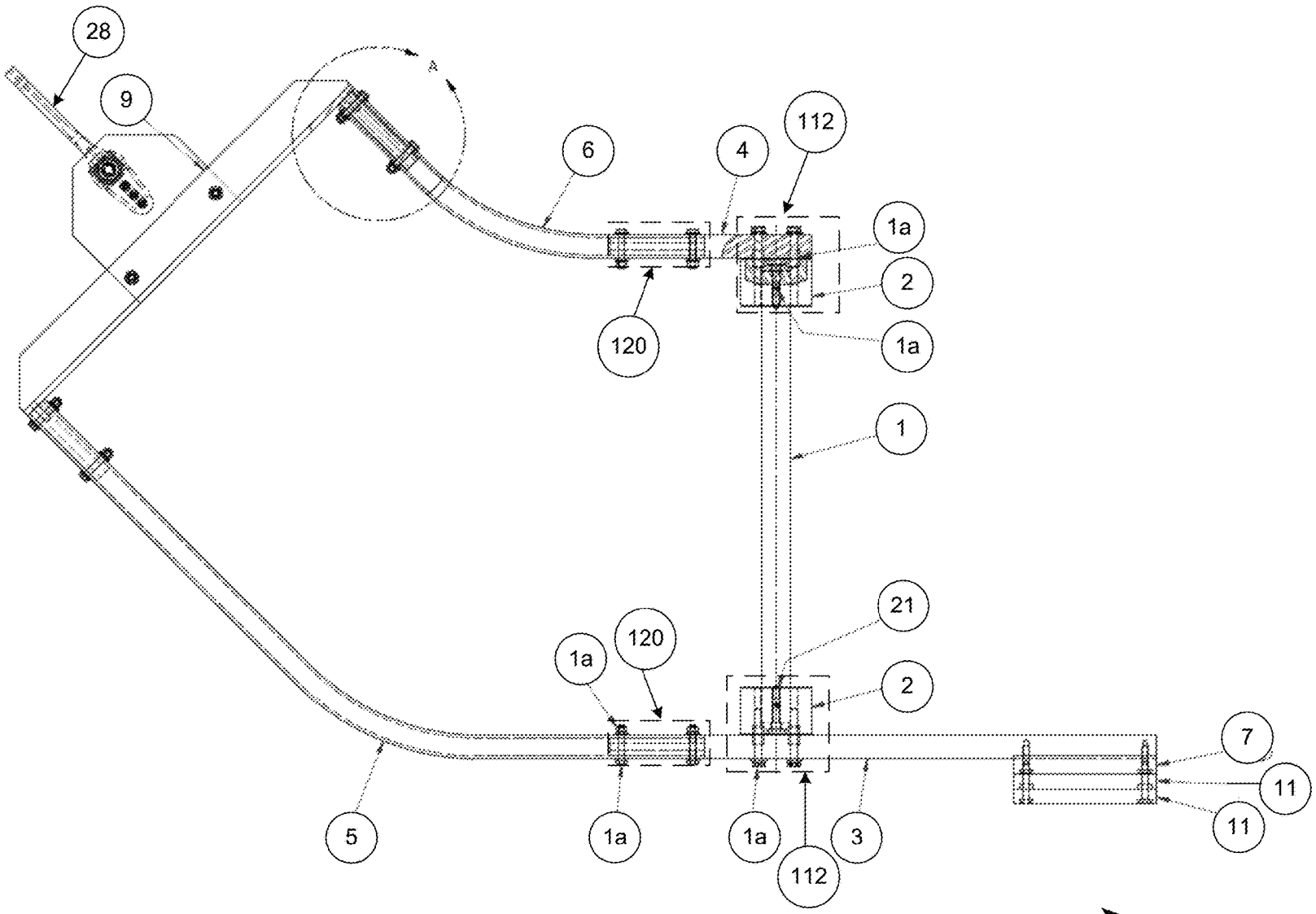
FIG. 9 illustrates an example 180 degree arm assembly of a device for a warning or barrier gate, in accordance with various embodiments of the present disclosure.

Referring to FIG. 9, shown is an example of a device 200 having a 180 degree arm assembly. The device 200 can also be seen as another example of the device 100. The device 200 can include an arm assembly 109, arm section 115, and arm section 118, a crossmember 121, and/or other components as further described below.

In the example of FIG. 9, the first arm section 115 from FIGS. 2, 3, and 4 can be a short side arm 4 that terminates in a tenon or other mating protrusion. The second arm section 118 from FIGS. 3, 4, and 5 can be a short tube arm 6 that terminates in a mortise or other groove. In FIG. 9, elements 120 indicates where the mortise and the tenon have been bolted to form at least part of the arm assembly 109.

The device 200 depicted in FIG. 9 also includes another arm assembly 109. The other arm assembly 109 includes a long side arm 3 and a long tube arm 5. The long side arm 3 and the long tube arm 5, which respectively provide examples of the first arm section 115 and the second arm section 118 from previous figures, are depicted at element 120 as bolted together using fasteners 1*a* to form at least part of the arm assembly 109.

The device 200 also includes a lift shaft 1. The short side arm 4 or the long side arm 3 can include a terminal end configured to be connected to a flange 2 of the lift shaft 1. In FIG. 9, the short side arm 4 and the long side arm 3 are shown as connected via apertures 112 to a respective flange 2 on opposing ends of the lift shaft 1. The lift shaft 1 can include a gate operator key 21 and the operator system can include a key way to maintain proper positioning of the lift shaft 1.

The long side arm 3 of the device 200 is depicted with one or more counterweights 133 attached. The device 200 can include the counterweights 7, 11 attached to the long side arm 3 to balance the arm assembly 109. The device 200 can also include a crossmember 121 that is depicted as the end angle 9. A breakaway arm 28 can be attached to the end angle 9.

The short tube arm 6 and the long tube arm 5 can include one or more angular bends that can be beneficial for operation of the 180 degree arm assembly of the device 200. For example, a portion of short tube arm 6 or the long tube arm 5 arm can provide an angular bend, such as curved with the 45 degree angle as shown.

FIG. 9 thus depicts an arm assembly 109 where the first arm section 115 is a short side arm 4 that includes terminal ends, where one of the terminal ends includes a tenon 115*a* with an end 115*b* (as depicted in FIG. 2). The short side arm 4 has an arrangement of apertures 115*c* through the end 115*b* of the tenon 115*a*.

The arm assembly 109 includes a second arm section 118 that is a short tube arm 6 with terminal ends, where one of the terminal ends includes a mortise 118*a* with an end 118*b*. The short tube arm 6 has an arrangement of apertures 118*c* through the end 118*b* of the mortise 118*a* (as depicted in FIG. 3).

The arrangement of apertures 115*c* through the end 115*b* of the tenon 115*a*, and the arrangement of apertures 118*c* through the end 118*b* of the mortise 118*a* are located on the first arm section 115 and the second arm section 118, respectively, such that the arrangement of apertures through the end 115*b* of the tenon 115*a* aligns with the arrangement of apertures 118*c* through the end 118*b* of the mortise 118*a* when a first element such as a mating protrusion of the tenon 115*a* aligns with a groove of the mortise 118*a*. The callout circle with reference "A" in FIG. 9 is also depicted in FIG. 10.

Figure 10:
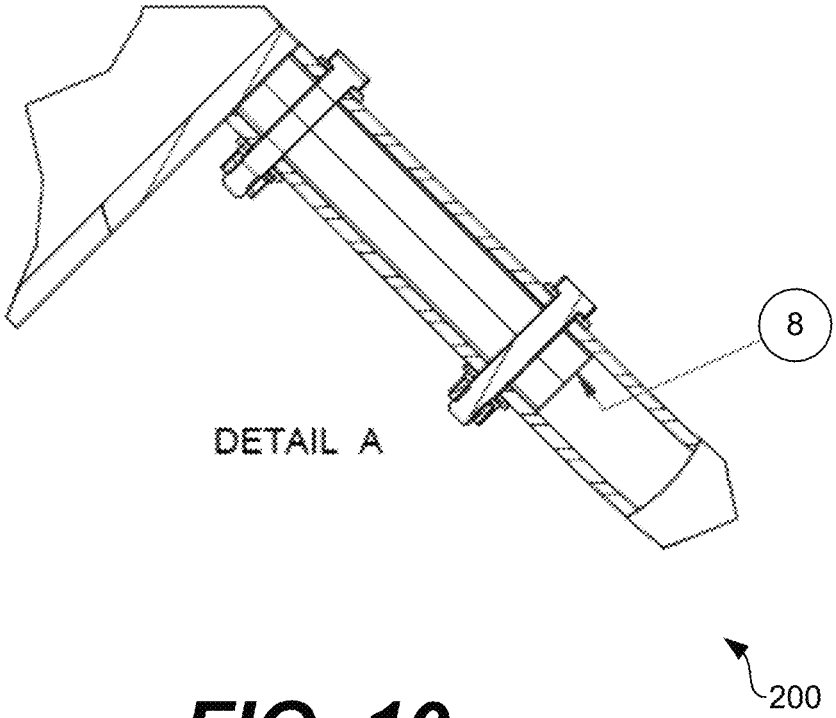
FIG. 10 illustrates a detail A of a 180 degree arm assembly of the device of FIG. 9, in accordance with various embodiments of the present disclosure.

Moving on to FIG. 10, shown is an example of a device 200 having a 180 degree arm assembly. FIG. 10 depicts a closer view of a detail A shown in FIG. 9. The device 200 can include an end cap 8 positioned as shown.

Figure 11A:
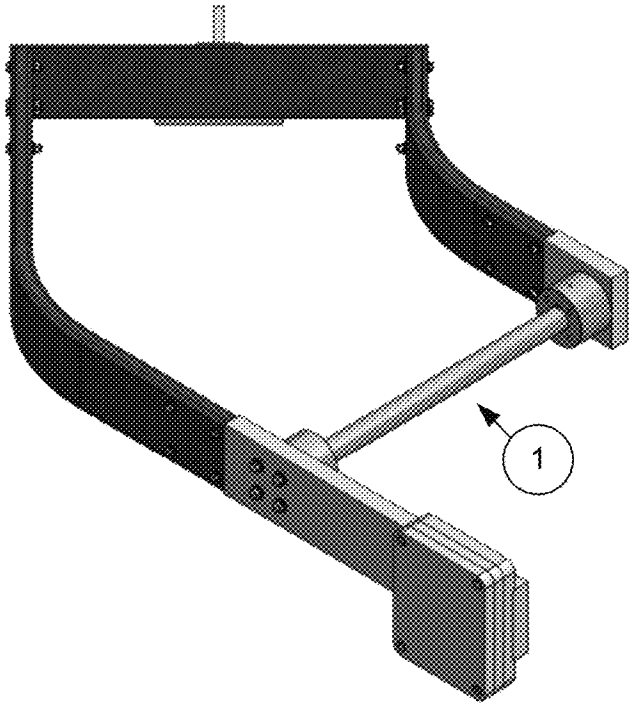
FIGS. 11A and 11B shows example three-dimensional renderings of the device of FIG. 9, in accordance with various embodiments of the present disclosure.
Figure 11B:
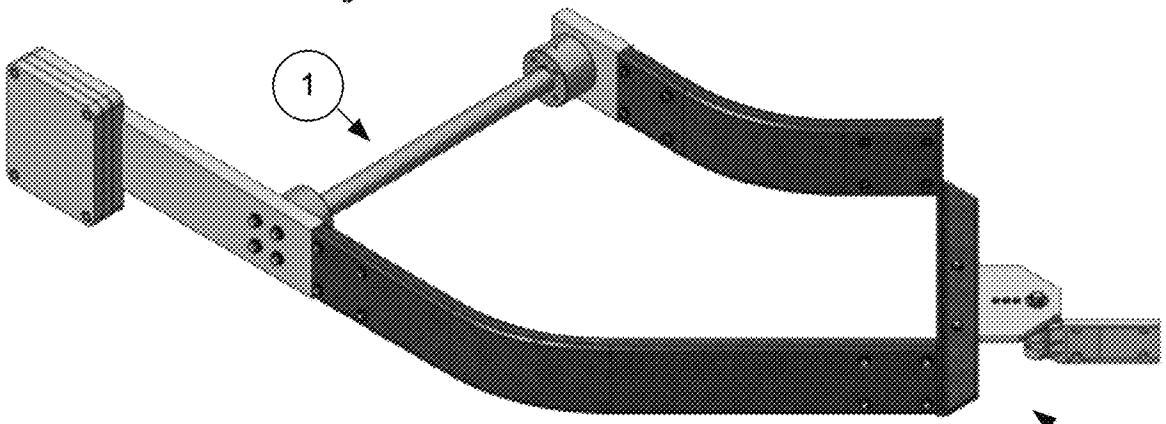

FIGS. 11A and 11B show example three-dimensional renderings of a device 200 having a 180 degree arm assembly. FIGS. 11A and 11B can be seen as respectively showing the device 200 in an open position and a closed position. The example of FIG. 11A shows the device 200 is able to position a breakaway arm to rest parallel to a roadway. Continuing with the example of FIG. 11A, the operator system can move at least part of the arm assembly 109 greater than 90 degrees along the lift shaft 1 by the rotation of the lift shaft 1. FIG. 11B shows the arm assembly 109 has been moved 180 degrees to a position where a breakaway arm can be perpendicular to (e.g., blocking) a direction of travel.

Figure 12A:
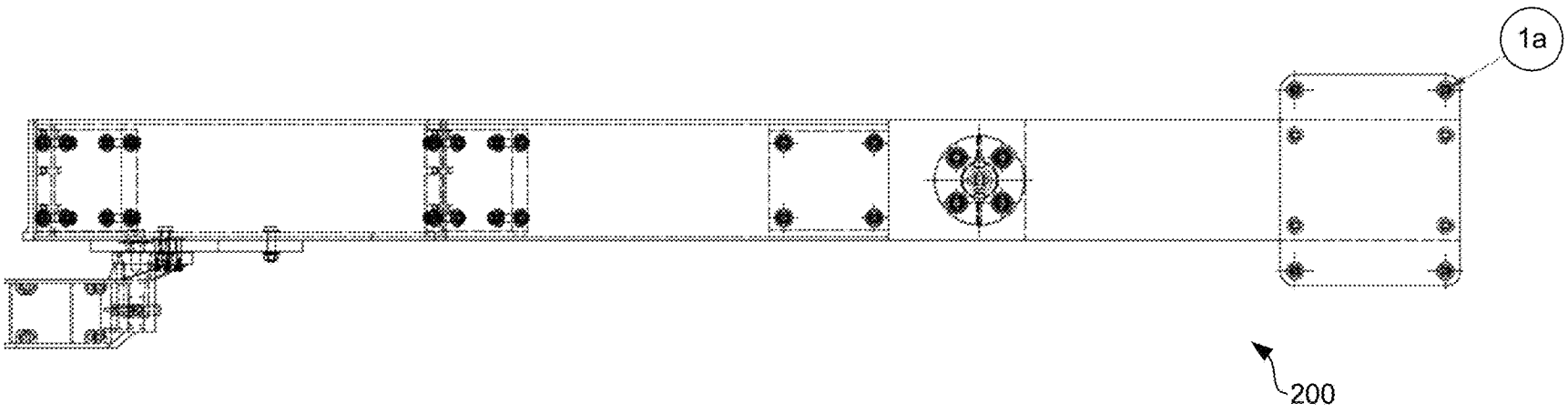
FIGS. 12A and 12B illustrate additional examples of the device of FIG. 9, in accordance with various embodiments of the present disclosure.

Referring to FIG. 12A, shown is another example of a device 200 having a 180 degree arm assembly. The drawing depicts an additional view of an example 180 degree arm assembly of device 200.

Figure 12B:
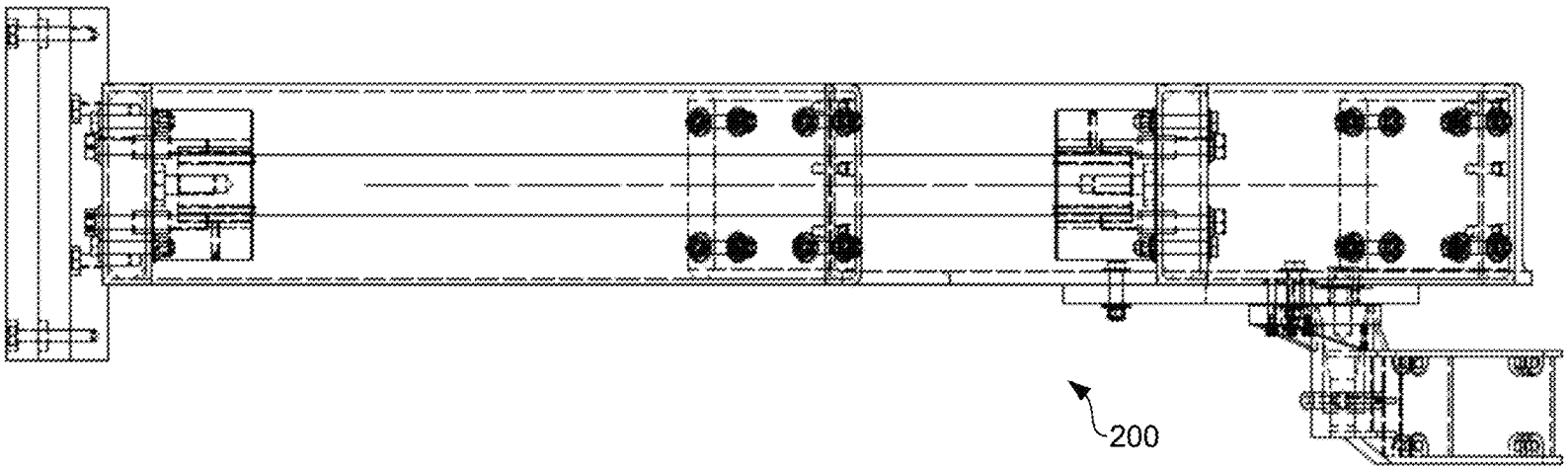

FIG. 12B shows another example of a device 200 having a 180 degree arm assembly. The drawing depicts an additional view of an example 180 degree arm assembly of device 200.

Figure 13:
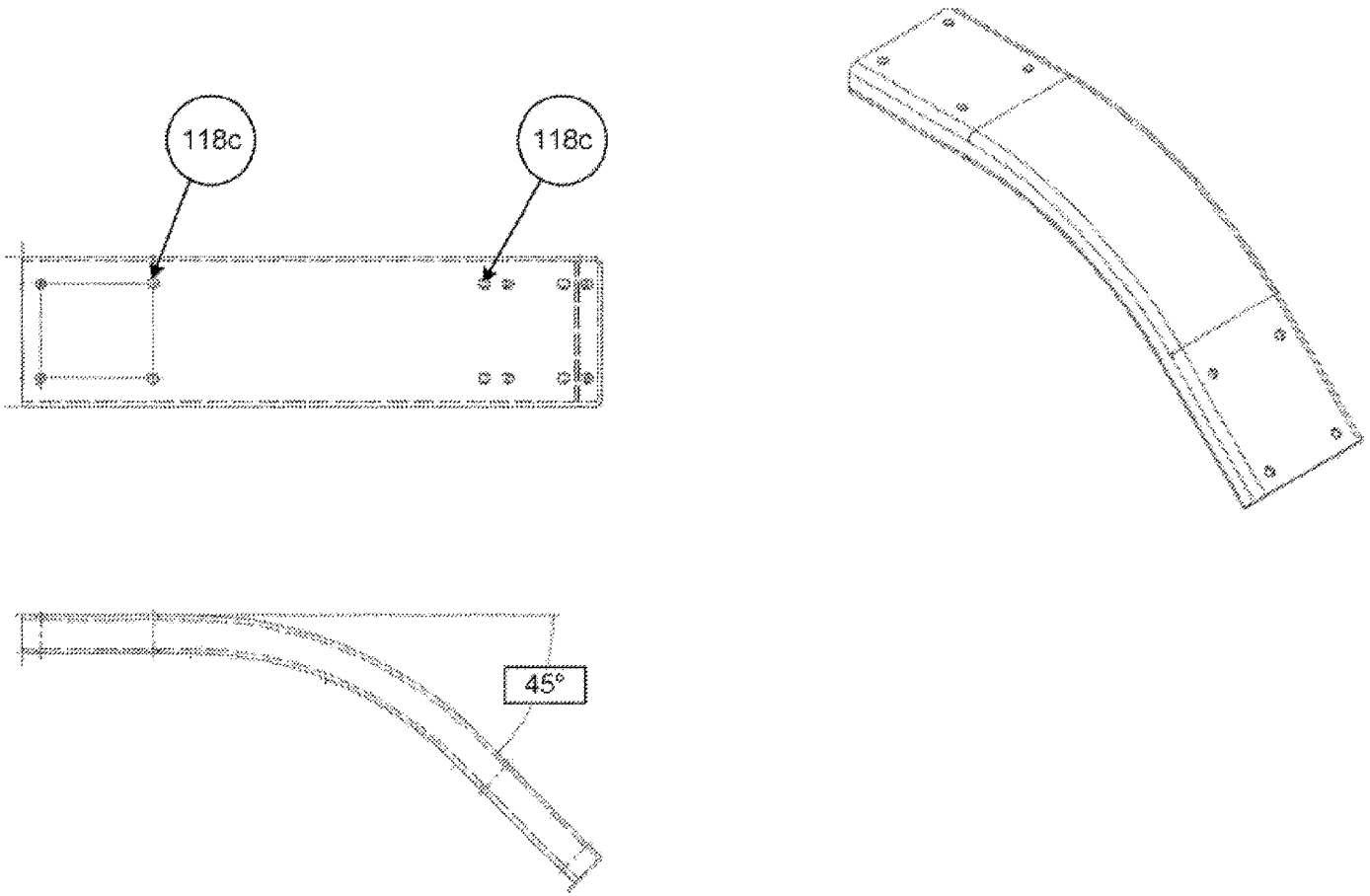
FIG. 13 illustrates an example of a short tube arm of the device of FIG. 9, in accordance with various embodiments of the present disclosure.

Regarding arms on the short side of the arm assembly of the device 200, FIG. 13 shows a detail view of a short tube arm 6 of a device 200 having a 180 degree arm assembly. At least a portion of the short tube arm 6 can provide an angular bend, including by being curved with the 45 degree angle as shown. There is a first arrangement of apertures 118*c* for attaching the short tube arm 6 to a short side arm 4. There is a second arrangement of apertures 118*c* for attaching the short tube arm 6 to an end angle 9.

Figure 14:
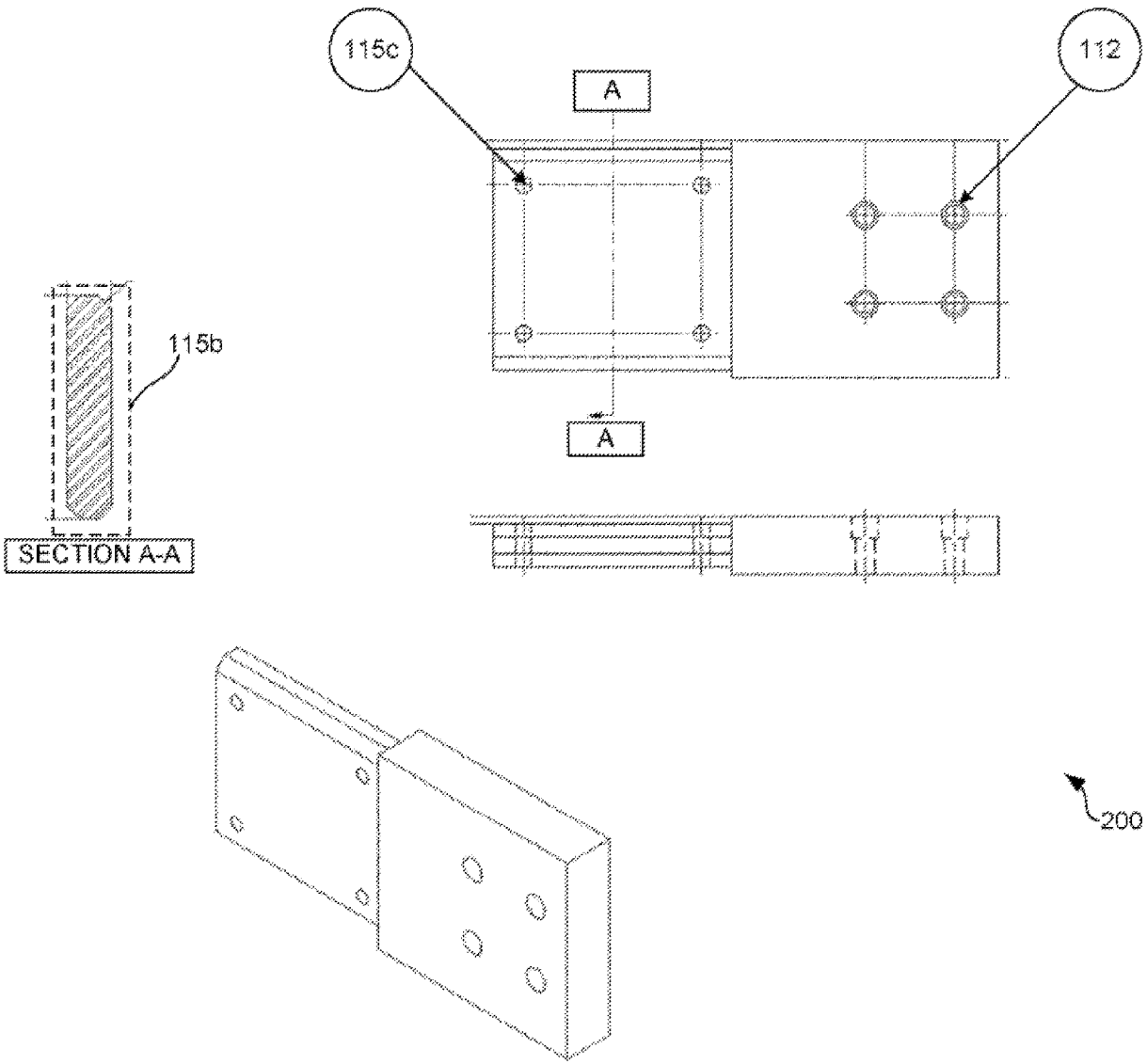
FIG. 14 illustrates an example of a short side arm of the device of FIG. 9, in accordance with various embodiments of the present disclosure.

FIG. 14 shows a detail view of a short side arm 4 of a device 200 having a 180 degree arm assembly. The end 115*b* shows that the tenon 115*a* can include an element that is substantially U- or V-shaped, inverted U- or V-shaped, or another shape that provides a mating protrusion. There is an arrangement of apertures 115*c* for attaching the short side arm 4 to the short tube arm 6. The apertures 112 are provided for fastening the short side arm 4 to a shaft or other mechanism of an operator system (not depicted) that can pivot the arm assembly 109.

Figure 15:
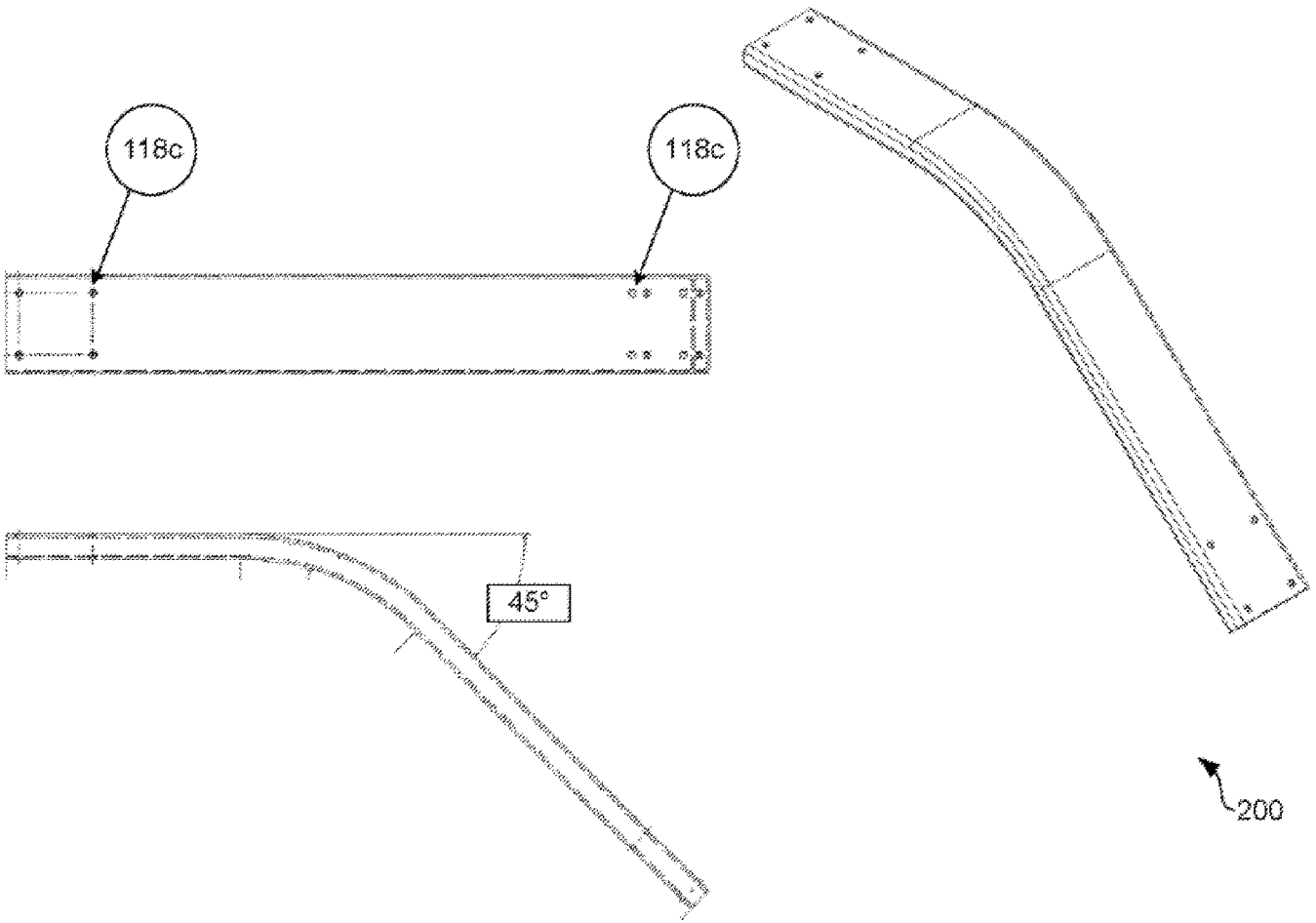
FIG. 15 illustrates an example of a long tube arm of the device of FIG. 9, in accordance with various embodiments of the present disclosure.

Regarding arms on the long side of the arm assembly of the device 200, FIG. 15 depicts a detail view of a long tube arm 5 of a device 200 having a 180 degree arm assembly. At least a portion of the long tube arm 5 can provide an angular bend, including by being curved with the 45 degree angle as shown. There is a first arrangement of apertures 118*c* for attaching the long tube arm 5 to a long side arm 3. There is a second arrangement of apertures 118*c* for attaching the long tube arm 5 to an end angle 9.

Figure 16:
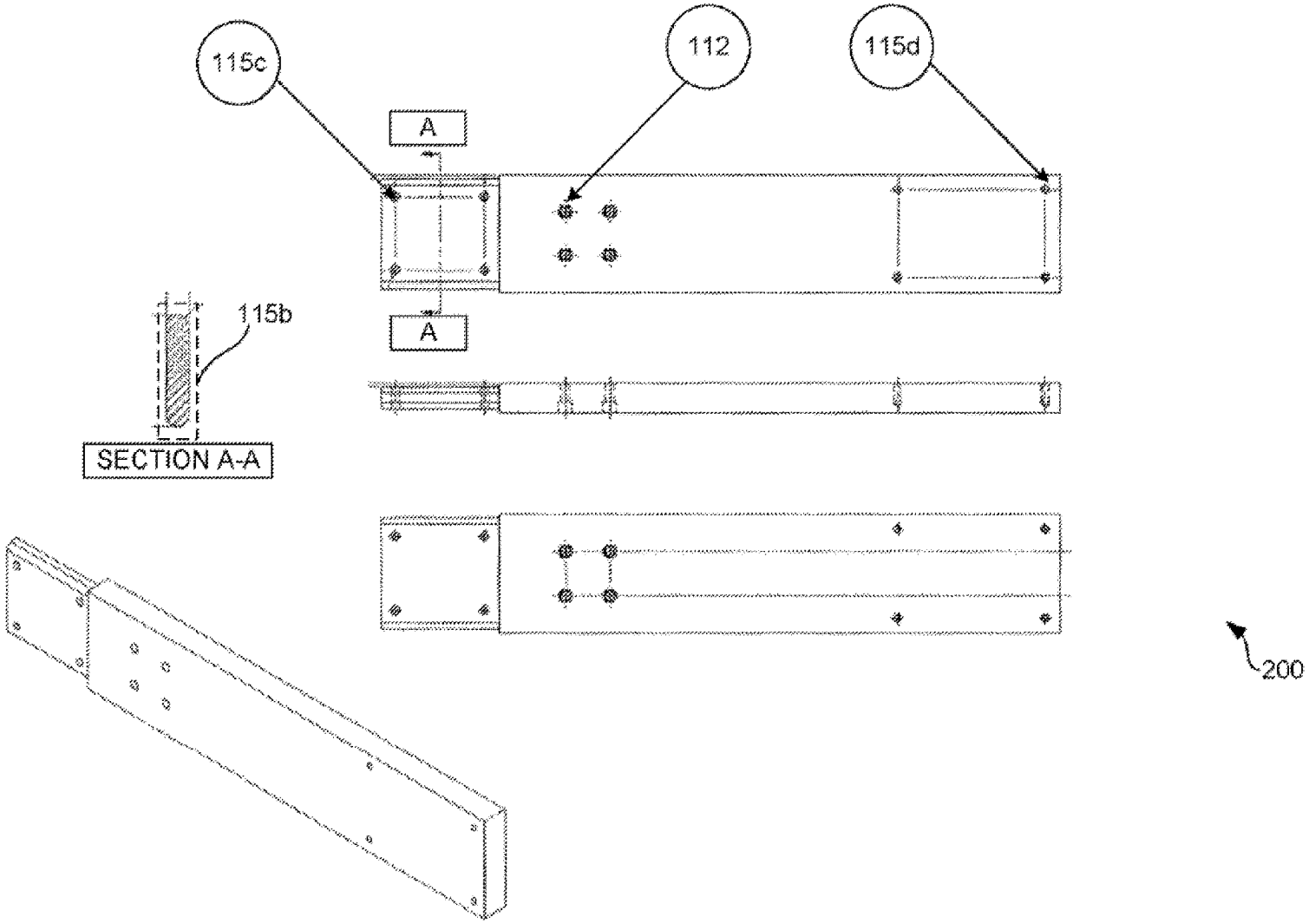
FIG. 16 illustrates an example of a long side arm of the device of FIG. 9, in accordance with various embodiments of the present disclosure.

FIG. 16 shows a detail view of a long side arm 3 of a device 200 having a 180 degree arm assembly. The end 115*b* shows that the tenon 115*a* can include an element that is substantially U- or V-shaped, inverted U- or V-shaped, or another shape that provides a mating protrusion. There is an arrangement of apertures 115*c* for attaching the long side arm 3 to the long tube arm 5. The apertures 112 are provided for fastening the long side arm 3 to a shaft or other mechanism of an operator system (not depicted) that can pivot the arm assembly 109. FIG. 16 also depicts an arrangement of apertures 115*d* through an end of the long side arm 3 that are configured to be attached to one or more counterweights 133, such as the counterweights 7 and 11 (FIG. 9), to balance the arm assembly 109.

Referring to FIG. 17, depicted is a flowchart illustrating an example method 800 for manufacturing a device for a warning or barrier gate. The method 800 begins at step 803 by aligning a first arm section 115, 3, or 4 and a second arm section 118, 5, or 6, where the first arm section 115, 3, or 4 terminates in a tenon (e.g., 115*a*), and the second arm section 118, 5, or 6 terminates in a mortise (e.g., 118*a*), and the mortise (e.g., 118*a*) is proximate to and aligns with the tenon (e.g., 115*a*) when the first arm section 115, 3, or 4 is aligned with the second arm section 118, 5, or 6. In some examples, the first arm section 115 includes a long side arm 3 or a short side arm 4 and the second arm section 118 includes a long tube arm 5 or a short tube arm 6.

The method 800 continues at step 806 by forming a mechanical bond between the mortise (e.g., 118*a*) and the tenon (e.g., 115*a*). At step 809, the method 800 can include bolting or otherwise removably fastening the mortise (e.g., 118*a*) and the tenon (e.g., 115*a*) to form at least part of the arm assembly 109. The method 800 can also include bolting or otherwise removably fastening a crossmember 121 to the at least part of the arm assembly 109. In some examples, the method 800 includes bolting or otherwise removably fastening the at least part of the arm assembly 109 to a flange 2 of a lift shaft 1. The method 800 can also include bolting or otherwise removably fastening a second arm assembly 109 to the crossmember 121 and to another flange 2 of the lift shaft 1 to form a parallel arm assembly. The method 800 can further include an operator system configured to be mounted at a 45 degree angle relative to at least one of: a roadway, a side of a structure, a breakaway arm, or an orientation of an operator system of a 90 degree arm. Thereafter the method can end.

Figure 18:
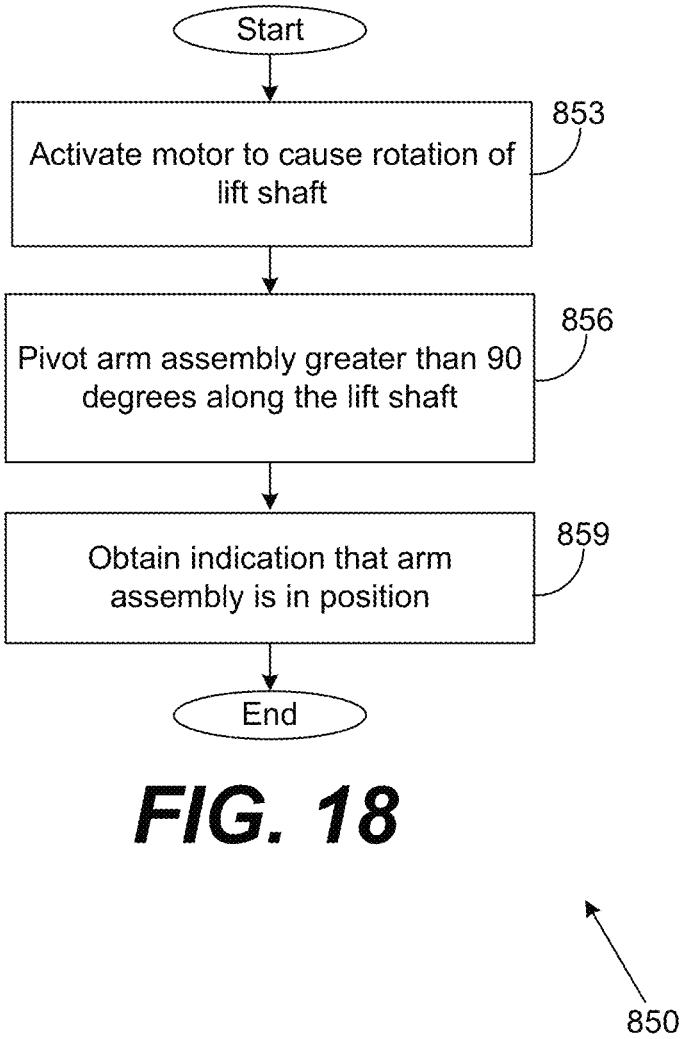
FIG. 18 is a flowchart illustrating an example method for reciprocating a warning or barrier gate between an open position and a closed position, in accordance with various embodiments of the present disclosure.

Referring to FIG. 18, depicted is a flowchart illustrating an example method for reciprocating a warning or barrier gate between an open position and a closed position. The method 850 begins at step 853 by activating a motor to cause rotation of a lift shaft 1. At step 856, the method 850 continues by pivoting at least part of the arm assembly 109 greater than 90 degrees along the lift shaft 1 by the rotation of the lift shaft 1. The direction of the movement of the arm assembly 109 can be made according to a direction of the rotation of the lift shaft 1. The pivoting of the at least part of the arm assembly 109 can be effective to move at least one arm assembly 109 and generate a torque that is effective to pivot a warning or barrier gate between an open and a closed position, or about a rotational center of the lift shaft 1. Moving the at least part of the arm assembly 109 greater than 90 degrees can include moving the at least part of the arm assembly 109 about 180 degrees along the lift shaft 1.

The method 850 can continue at step 859 by obtaining an indication that the arm assembly 109 is in a position, such as the closed position or the open position. The open position can be substantially parallel to a structure. For example, the method 850 can include setting an angle of a cam limit using at least one of an encoder or a resolver device. A programmable logic controller (PLC) can be used to set the angle of the cam limit or to control other aspects of the device 200. When the PLC detects the appropriate angle of the arm assembly 109, the PLC can communicate a signal to the operator system 22*a* (FIG. 8) or the operator system 22*b* (FIG. 8). Thereafter the method can end.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims. In addition, all optional and preferred features and modifications of the described embodiments and dependent claims are usable in all aspects of the disclosure taught herein. Furthermore, the individual features of the dependent claims, as well as all optional and preferred features and modifications of the described embodiments are combinable and interchangeable with one another.

Although embodiments have been described herein in detail, the descriptions are by way of example. The features of the embodiments described herein are representative and, in alternative embodiments, certain features and elements may be added or omitted. Additionally, modifications to aspects of the embodiments described herein may be made by those skilled in the art without departing from the spirit and scope of the present invention defined in the following claims, the scope of which are to be accorded the broadest interpretation so as to encompass modifications and equivalent structures.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

The term "substantially" is meant to permit deviations from the descriptive term that don't negatively impact the intended purpose. Descriptive terms are implicitly understood to be modified by the word substantially, even if the term is not explicitly modified by the word substantially.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, the following is claimed:

1. A method of manufacturing an arm assembly for a warning or barrier gate, comprising:

aligning a first arm section and a second arm section, where the first arm section terminates in a tenon, and the second arm section terminates in a mortise, and the mortise is proximate to and aligns with the tenon when the first arm section is aligned with the second arm section;

forming a mechanical bond between the mortise and the tenon;

removably fastening the mortise and the tenon to form at least part of the arm assembly; and wherein the arm assembly is configured to rotate about a lift shaft and a rotational center of the lift shaft is offset about 45 degrees from a breakaway arm connected to the second arm section.

2. The method of claim 1, further comprising removably fastening a crossmember to the at least part of the arm assembly.

3. The method of claim 1, further comprising removably fastening the at least part of the arm assembly to a flange of the lift shaft.

4. The method of claim 3, further comprising removably fastening a second arm assembly to another flange of the lift shaft to form a parallel arm assembly.

5. The method of claim 1, wherein the first arm section comprises a side arm and the second arm section comprises a tube arm.

6. The method of claim 5, wherein a portion of the tube arm is curved at about a 45 degree angle.

7. The method of claim 1, wherein the arm assembly is configured to rotate about the lift shaft about 180 degrees between an open position and a closed position, wherein the open position is substantially parallel to a structure or roadway and the closed position is substantially perpendicular to a structure or roadway.

8. An arm assembly for a warning or barrier gate, comprising:

a first arm section comprising first terminal ends, at least one of the first terminal ends comprising a tenon, the first arm section having an arrangement of bolt apertures through the tenon;

a second arm section comprising second terminal ends, at least one of the second terminal ends comprising at least one mortise, the second arm section having an arrangement of bolt apertures through the at least one mortise;

wherein the arrangement of bolt apertures through the tenon, and the arrangement of bolt apertures through the at least one mortise are located on the first arm section and the second arm section, respectively, such that the arrangement of bolt apertures through the tenon aligns with the arrangement of bolt apertures through the at least one mortise when a first element is aligned with a second element; and wherein the arm assembly is configured to rotate about a lift shaft and a rotational center of the lift shaft is offset about 45 degrees from a breakaway arm connected to the second arm section.

9. The arm assembly of claim 8, wherein the first arm section comprises a side arm and the second arm section comprises a tube arm.

10. The arm assembly of claim 9, wherein a portion of the tube arm is curved at about a 45 degree angle.

11. The arm assembly of claim 8, wherein the first arm section comprises another terminal end configured to be connected to a flange of the lift shaft.

12. The arm assembly of claim 8, wherein the second terminal ends further comprise a terminal end configured to be connected to a crossmember.

13. The arm assembly of claim 12, wherein the crossmember comprises a tenon and an arrangement of bolt apertures through the tenon.

14. The arm assembly of claim 8, further comprising an operator system configured to be mounted at about a 45 degree angle relative to at least one of: a roadway, a side of a structure, the breakaway arm, or an orientation of an operator system of a 90 degree arm.

15. The arm assembly of claim 8, wherein the mortis comprises a groove and the tenon comprises a mating protrusion, wherein the first element is substantially U-shaped and the second element comprises a mirror image of the first element.

16. The arm assembly of claim 8, wherein the arm assembly is configured to rotate about the lift shaft about 180 degrees between an open position and a closed position, wherein the open position is substantially parallel to a structure or roadway and the closed position is substantially perpendicular to a structure or roadway.

* * * * *